United States Patent [19]

Henley

[11] 4,136,217

[45] Jan. 23, 1979

[54] REMOVING OIL EMULSION FROM ARTICLES PRIOR TO COATING ARTICLES AND RECOVERING OIL FROM THE EMULSION

[75] Inventor: Thomas D. Henley, Havertown, Pa.

[73] Assignee: Amchem Products, Ambler, Pa.

[21] Appl. No.: 763,217

[22] Filed: Jan. 27, 1977

[51] Int. Cl.[2] ..... C23G 5/00

[52] U.S. Cl. ..... 427/327; 427/239; 134/10; 134/40; 134/28; 260/412.5; 252/358

[58] Field of Search ..... 427/327; 134/3, 25 A, 134/25 R, 41; 260/412.5, 705; 210/DIG. 5; 252/358; 72/41, 42

[56] References Cited

U.S. PATENT DOCUMENTS

| | | | |
|---|---|---|---|
| 2,711,978 | 6/1955 | Groom | 134/10 |
| 3,025,190 | 3/1962 | Groom | 134/10 |
| 3,450,086 | 6/1969 | Maddock | 134/10 X |
| 3,964,936 | 6/1976 | Das | 148/6.27 X |
| 4,082,867 | 4/1978 | Henley et al. | 427/327 |

FOREIGN PATENT DOCUMENTS

| | | | |
|---|---|---|---|
| 2033522 | 1/1972 | Fed. Rep. of Germany | 252/358 |

*Primary Examiner*—Ralph S. Kendall
*Attorney, Agent, or Firm*—Dale Lynn Carlson

[57] ABSTRACT

In a continuous process wherein corrosion resistant and paint adherent coatings are formed on metallic articles and wherein prior to the formation of said coatings, the articles are first subjected to a pre-cleaning stage in which oil emulsion is removed from the surfaces of the articles by washing the articles with an aqueous solution of wash water and demulsifier and the removed oil emulsion is broken and the oil recovered, and wherein the articles having the oil emulsion removed from their surfaces are thereafter subjected to a second cleaning stage in which the articles are contacted with a cleaning solution to remove metal fines from the surfaces of the articles, the improvement comprising including a chelating agent in said aqueous solution of wash water and demulsifier to aid in breaking said oil emulsion and to deter or prevent the formation of precipitates in the cleaning solution of said second cleaning stage.

17 Claims, 1 Drawing Figure

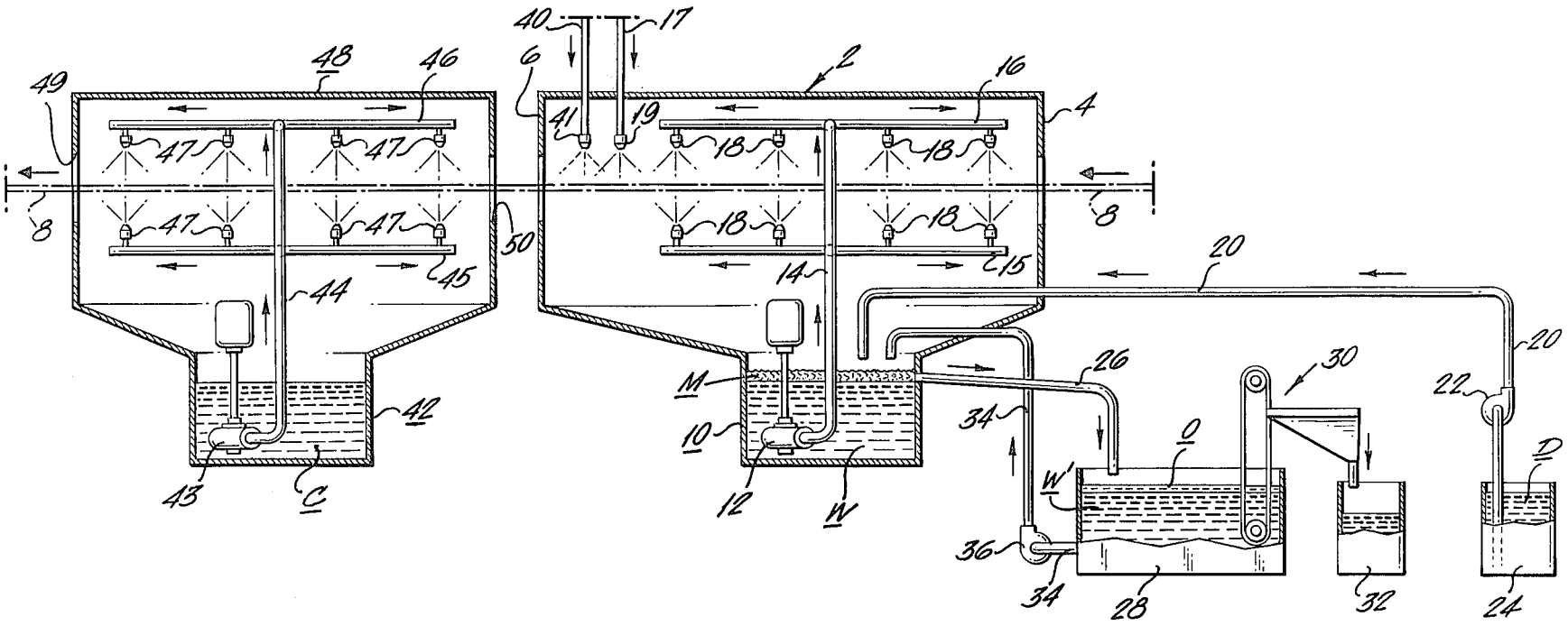
20
D
24
22
32
30
20
O
28
26
W'
34
34
36
4
8
16
15
18
18
2
W
14
12
18
18
M
10
17
19
41
40
6
50
46
45
47
47
42
48
44
C
47
47
43
49
8

REMOVING OIL EMULSION FROM ARTICLES PRIOR TO COATING ARTICLES AND RECOVERING OIL FROM THE EMULSION

FIELD OF THE INVENTION

This invention relates to the cleaning of articles having an oil emulsion thereon prior to forming on the articles corrosion resistant and paint adherent coatings. This invention also relates to breaking an oil in water emulsion and to recovering oil the so that discharge of the oil into a sewage treatment system can be avoided.

The present invention is described in connection with a process involving the formation of cans (for example, aluminum or tinplate cans) by the drawing and ironing technique and to the subsequent surface treatment of the cans, including the cleaning and coating thereof. However, it should be appreciated that various principles underlying the present invention can be used in other types of applications.

Over the past few years, more and more products have been packaged in cans made by the drawing and wall-ironing technique. (Cans made by this technique are often referred to as "D & I cans".) This wide spread use has led to the development of integrated assembly lines wherein the following process steps are carried out in a continuous operation;

(1) manufacturing the D & I can by drawing and wall-ironing, which includes cooling and lubricating the metal surfaces with an oil in water emulsion (hereinafter referred to as an "oil emulsion");

(2) pre-cleaning or pre-washing the cans to remove therefrom the oil emulsion;

(3) cleaning the pre-washed cans by subjecting them to an alkaline or acidic cleaning solution to remove therefrom foreign materials, including, for example, metal fines which emanate from the drawing and wall-ironing operation and which tend to cling tightly to the surfaces of the cans; and (4) coating the cleaned cans, including forming sequentially thereon a corrosion resistant and paint adherent coating and a decorative coating, such as that comprising a paint, lacquer, or ink finish; and (5) filling and topping the cans.

The present invention is related to steps (2) and (3) above which are generally carried out in separate stages. The step (3) cleaner, an aqueous solution usually containing a plurality of chemical compounds, is typically recycled and reused for the purpose of realizing economic savings. If step (3) is combined with step (2), the oil emulsion which is removed from the cans tends to make it difficult to effectively recycle the cleaner.

With respect to step (2) above, it has not been uncommon to discharge the oil emulsion which is removed from the cans into a sewage system or directly into the environment. This creates problems because such oil emulsions tend to have adverse effects on sewage treatment processes and on the environment, and the practice can also be in derogation of environmental laws which are designed to discourage and prevent such conduct.

As will be seen from the discussion which follows, methods are available for treating the oil emulsion to break it. However, the heretofore known methods have certain disadvantages as will be explained below.

DESCRIPTION OF PRIOR ART

It is known that an oil emulsion can be broken by adding thereto an electrolyte, that is, a water soluble compound which dissociates in water and causes the oil to separate by demulsifying action.

A known practice in D & I can manufacture involves passing a portion of the step (3) cleaner, generally acidic, into the wash water/oil emulsion mixture in an attempt to break the oil emulsion. The resulting mixture is discharged as effluent. This results in a loss of said cleaner portion to the discharged effluent and provides no opportunity to separate and recover the oil due to the turbulent condition of the mixture and the stability of the emulsion.

A more recent development in this field is described in U.S. Pat. application Ser. No. 483,754, of Henley and Reeves, filed June 27, 1974, abandoned in favor of divisional application Ser. No. 713,806, filed Aug. 12, 1976, now U.S. Pat No. 4,082,867, each assigned to the same assignee as the present invention. The development described in this application involves removal of the oil emulsion from the articles by contacting them with an aqueous solution of wash water and demulsifier which is effective in breaking the oil emulsion and liberating the oil therefrom. (Examples of demulsifiers include ammonium and alkali metal sulfates and bisulfates and alkali metal phosphates and chlorides.) The articles are contacted with the aforementioned solution under conditions which result in the formation of a turbulent mixture of the wash water, demulsifier and oil emulsion. The turbulent conditions aid in breaking the oil emulsion and liberating oil. A quiescent stage is established in which the oil separates from the aqueous solution of wash water and in which the separated oil is allowed to collect in a separate phase which is substantially free of water. The oil phase is then removed from the wash water, for example, by skimming and the oil is recovered. The mixture of wash water and demulsifier from which the oil has been removed is recycled for contacting other articles having thereon an oil emulsion.

While a number of important benefits are realized in an operation which includes use of the development described immediately above, there are applications when its use has resulted in certain problems. Speaking generally, the problems arise the step (3) above, that is, the stage of the process in which the pre-washed cans (substantially free of oil emulsion) are subjected to the cleaning solution. In this stage, the cleaning solution is sprayed onto the cans, collected and then recycled for spraying additional cans. During the course of the operation of the process, it has been found that there is a tendency for precipitates to form in the collected cleaning solution. The formation of such precipitates can adversely affect the operation of the process. For example, the precipitates can block spray nozzles and thus interfere with this application of the cleaning solution. In addition, any precipitate which passes through the spray nozzles can deposit on and cling to the surfaces of the cans. The presence of such foreign materials on the surfaces of the cans can adversely affect the subsequent coating operation (step (4) above). As the process is continued, the precipitates can build up in concentration and the problems can become so severe that it is necessary to terminate the operation, dispose of the cleaning solution, and renew the operation with fresh uncontaminated cleaning solution. This, of course, is a time consuming and costly operation.

One of the objects of the present invention is to provide an improved process in which the formation of precipitates is deterred or prevented.

SUMMARY OF THE INVENTION

One aspect of the present invention is directed to a continuous process of the type wherein oil emulsion is removed from the surfaces of a plurality of articles by contacting the surfaces with an aqueous solution containing a demulsifier for breaking said oil emulsion and wherein said surfaces having said oil emulsion removed therefrom are subsequently contacted with a cleaning solution, wherein said cleaning solution is recycled for contacting additional of said surfaces and wherein precipitates tend to be formed in said recylced cleaning solution, the improvement of the invention comprising contacting said surfaces having thereon said oil emulsion with said aqueous solution having included therein a chelating agent. In accordance with the invention, it has been found that the addition of the chelating agent to said aqueous solution of demulsifier is effective in deterring or preventing the formation of said precipitates in the cleaning solution used in the subsequent stage of the process.

Another aspect of this invention is directed to a process for breaking an oil emulsion comprising contacting the oil emulsion with an aqueous solution of a demulsifier and a chelating agent. As mentioned above, it is known to use demulsifiers to break oil emulsions. In accordance with this invention, it has been found that the rate of separation of oil from the oil emulsion can be increased significantly by using a chelating agent in combination with the demulsifier.

The preferred chelating agent used in the practice of the present invention is citric acid. In addition to being readily available and relatively inexpensive, the use of citric acid results in a combination of a number of benefits. It is effective in preventing or deterring the formation of precipitates in the cleaning solution and in increasing the rate of separation of oil from the oil emulsion when used in relatively small amounts. In addition, its use does not present any peculiar problems with respect ot aspects of the overall cleaning and coating operation.

BRIEF DESCRIPTION OF THE FIGURE

The FIGURE is a schematic representation of equipment which can be used in the practice of the present invention.

DETAILED DESCRIPTION OF THE INVENTION

The use of a chelating agent in accordance with the present invention is described hereafter in connection with the type of system disclosed in aforementioned U.S. Pat. application Ser. No. 483,754 and U.S. Pat. No. b 4,082,867. However, it should be understood that the present invention can be used in other types of systems and applications.

With reference to the FIGURE, there is shown a conventional spray enclosure 2, having openings at sides 4 and 6 for receiving a conveyor 8 carrying inverted cans (not shown) having their surfaces covered with oil emulsion. A typical oil emulsion contains oil, water, emulsifying agents and other additives known to the art. An aqueous wash solution W containing water, demulsifier and chelating agent, generally heated, for example, to a temperature of about 110 to about 130° F., is pumped from the bottom of the wash water collection tank 10 by the pump 12 through pipes 14, 15 and 16 which spray the aqueous solution under pressure, for example, about 15 to about 20 lbs/in$^2$, through nozzles 18 onto the inverted cans. A mixture of the aqueous solution containing wash water, demulsifier and chelating agent and the washed-off oil emulsion in turbulent condition is collected in the wash water collection tank 10. In a typical operation, 500 to 2,500 cans per minute are processed, each can initially carrying as much as 0.5 g or more of oil emulsion.

There is added into the collection tank 10 through pipe 20 demulsifying solution D which is pumped by pump 22 from container 24 which contains an aqueous solution of demulsifier and chelating agent. The top portion of the turbulent mixture M in collection tank 10 comprises wash water, demulsifier, chelating agent, oil emulsion and any oil liberated from the emulsion. The bottom portion of the mixture in tank 10 contains wash water, demulsifier and chelating agent and is substantially free of oil emulsion and oil. The aforementioned top portion of the mixture is allowed to overflow (or it can be pumped) through pipe 26 into oil-separation tank 28. The inflow of the mixture into tank 28 and attendant apparatus are designed to permit the mixture to reach a quiescent condition, that is, a substantially still condition whereby the oil liberated from the emulsion, due to its having a lower specific gravity than the wash water, is allowed to float to the surface thereof and form an oil layer O thereon. The oil layer O is removed from the oil-separation tank 28 by a conventional rotating belt oil skimmer 30 and is deposited in the oil collection tank 32 which can be stored or removed to a place of use for the oil.

The wash water W′ underlying the oil layer O in the oil-separation tank 28 includes also demulsifier and chelating agent and any other ingredients liberated by the breaking of the oil emulsion such as emulsifying agents. This is transferred through pipe 34 by use of pump 36 to the wash water collection tank 10 from which it is recycled for contact with and washing of other oil emulsion-covered cans.

In preferred form, as shown in the drawing, but as an optional form, the cans are rinsed with water after the oil emulsion has been removed therefrom by spraying with wash water. This is accomplished by spraying rinse water through nozzle 19 fed thereto through pipe 17. This has the advantage that any residual demulsifier adhered to the can is washed off and collected in the wash water collection tank 10 for reuse. This also provides a means for adding to the closed system make-up wash water that may be needed. Rinse water is removed from the cans by spraying with forced air through nozzle 41 fed thereto through pipe 40.

After the oil emulsion is removed from the cans in the precleaning stage, the cans are cleaned with an acidic or alkaline cleaning solution C which is pumped from cleaner tank 42 by pump 43 through pipes 44, 45 and 46 which spray the cleaning solution C through nozzles 47 onto the inverted cans. Among other things, this cleaning step is effective in removing from the cans metal fines which cling tenaciously to the cans and which generally escape removal in the pre-cleaning or prewash stage described previously. The cleaning operation is accomplished in a conventional spray enclosure 48, having openings 49 and 50 for receiving conveyor 8.

It should be appreciated that the invention can be used in other types of applications which involve the breaking of an oil emulsion and in the cleaning of oil emulsion-covered articles other than D & I cans. For example, the articles may be panels, strips, brackets, etc., made from aluminum or other metal or from other materials.

In general, the oil emulsion presently used in D & I can operations contains hydrocarbon oils such as mineral oils. The present invention is applicable to other oil emulsions. Thus, the oil of the emulsion can be a natural or synthetic oil, for example, fatty oils and fatty acids, including sulfurized forms thereof, and silicon or other synthetic oils. The emulsions are generally made utilizing dispersing or emulsifying agents and can contain, for example, about 1 to about 20 wt. % of oil.

Any compound or mixture of compounds which are effective in breaking oil emulsion and which are referred to herein as "demulsifiers" can be used in the practice of the present invention. Speaking generally, such compounds are water soluble materials which dissociate in water. Examples of water soluble demulsifiers that can be used are: ammonium and alkali metal sulfates and bisulfates, including, for example, the sodium and potassium salts thereof and alkali metal phosphates and chlorides. It is preferable to use a demulsifier which is environmentally acceptable. The use of the aforementioned phosphates is particularly desirable in applications wherein the aforementioned stage (3) cleaner is alkaline, such as a phosphate cleaning solution.

The amount of demulsifier needed to break the oil emulsion will depend on many factors such as the particular demulsifier used, the amount of oil in the emulsion, the proportion of oil emulsion present in the wash water, the temperature of the wash water in which the oil emulsion is contained, the particular oil emulsion used, including the particular emulsifying agents in the emulsion, and the time allotted for liberating the oil from the emulsion. Accordingly, the amount used in any particular application should be selected on the basis of experience. For guideline purposes, it is noted that there has been used effectively about 0.5 to about 5 wt. % of the demulsifiers, said weight percent being based on the total weight of the wash water mixture, including the oil emulsion and chelating agent and the demulsifier.

The addition of a chelating agent to the aqueous demulsifying solution containing wash water and demulsifier aids in preventing the formation of precipitates in the aqueous demulsifying solution itself and in the subsequently used cleaning solution.

Examples of chelating agents that can be used are: citric acid, gluconic acid, ethylene diamine tetracetic acid and pyrophosphoric acid. To the extent that they are available, there can be used also water soluble salts of the aforementioned acids, including, for example, ammonium and alkali metal salts. Water soluble tripolyphosphates, including alkali metal tripolyphosphates, can be used also. In addition to the specific chelating agents that have been mentioned, the following are additional examples of specific chelating agents that can be used: sodium gluconate; sodium acid pyrophosphate, sodium tripolyphosphate; and sodium citrate.

The amount of chelating agent used should be an amount sufficient to prevent the formation of precipitates in the cleaning solution. The effective amount of chelating agent needed depends on various factors, including particularly the specific chelating agent used, as the complexing action of chelating agents can vary from one chelating agent to the next. As discussed in more detail below, it is believed that the precursors of precipitates in the cleaning solution are alkaline earth metal ions such as calcium and magnesium which are present in the aqueous solution of demulsifier. Accordingly, the minimum amount of chelating agent should be an amount effective to form soluble complexes with substantially all of the calcium and magnesium ions that may be present in the aqueous solution of demulsifier. For guideline purposes, it is recommended that the chelating agent should be used in a concentration of at least about 0.05 wt. %, based on the total weight of the wash water mixture including the oil emulsion, chelating agent and the demulsifier. In operations in which the cleaning solution used is an alkaline cleaning solution and in which the chelating agent used is an acid, the maximum concentration of chelating agent is governed by an amount which does not adversely affect the alkaline cleaning solution. In other types of applications, there appears to be no upper limit on the amount of chelating agent used, but economic considerations generally dictate against using amounts of chelating agent over and above that necessary to deter or prevent the formation of precipitates in the cleaning solution. It is recommended that the chelating agent be used in a concentration of about 0.1 to about 0.3 wt. %, although it should be understood that depending on the specific chelating agent used and other conditions of the process, the use of higher or lower amounts of chelating agent may be desirable.

A preferred composition which exhibits particularly good properties respecting the rate of separation of the oil is an aqueous solution comprising about 0.1 to about 0.3 wt. % of chelating agent and about 0.5 to about 5 wt. % of demulsifier. Preferred ingredients for use in this solution are citric acid and sodium sulfate.

In applications in which the cleaning solution is an alkaline cleaning solution and in which the chelating agent used is acidic, attention should be paid to the pH of the aqueous solution of demulsifier and chelating agent. In this connection, it is noted that if the pH of the alkaline cleaning solution (generally within the range of about 8 to about 12) is lowered, the cleaning effect of the solution is adversely affected and there is an aggravated tendency for precipitates to form in the alkaline cleaning solution. Acidic materials that are dragged into the cleaning solution by cans or other metal surfaces treated with the aqueous solution of demulsifier and chelating agent can tend to lower the pH of the alkaline cleaning solution to an extent that the aforementioned problems are encountered in applications where the aqueous solution of chelating agent and demulsifier is too acidic. In order to avoid or mitigate such problems, it is recommended that the pH of the aqueous solution containing demulsifier and chelating agent be within the range of about 5 to about 8.

For use in applications where the cleaning solution is acidic, the pH of the aqueous solution of demulsifier and chelating agent can be substantially lower, for example, as low as about 2.

The demulsifier and chelating agent may be added separately to the wash water in the pre-wash stage or they may be added in the form of an aqueous concentrate containing both the demulsifier and chelating agent. The aqueous concentrate comprises about 5 to about 30 wt. % of the demulsifier, although higher amounts of demulsifier up to its solubility limit in the concentrate can be included. The chelating agent comprises about 0.5 to about 5 wt. % of the aqueous concentrate.

The formation of precipitates in the cleaning solution has been a perplexing and puzzling problem. Although the cause of formation of the precipiates and the exact mechanism by which precipitate formation is avoided is not understood, the following is offered as an explanation. It is theorized that during the continued operation of the process, there is a drag-out from the pre-wash stage into the cleaning solution of materials carried by the cans as they travel from the pre-wash stage to the cleaning solution stage. It is believed that such materials are the precursors of the precipitates and that the materials may be calcium and/or magnesium, the source of which is the water used in preparing the aqueous solution of demulsifier. It is further theorized that such materials combine with ingredients of the cleaning solution, for example, phosphates, to form products which are insoluble in the cleaning solution. It is believed also that the addition of the chelating agent to the aqueous solution used in the pre-wash stage results in a complexing of the materials therein which are the precursors of the precipitates. It should be understood that the above is offered as a possible explanation which should not be construed to limit the claimed invention.

A particularly preferred operation includes the use of an aqueous demulsifying solution containing sodium sulfate and citric acid in the pre-wash stage and an alkaline phosphate cleaning solution in the subsequent cleaning stage. With respect to the use of citric acid, it is noted that it is a mild acid which can be used effectively in concentration ranges which do not adversely affect a subsequently used alkaline cleaning solution, as amounts of the citric acid are dragged into the cleaning solution by the articles being treated. In addition, the chelating properties of citric acid are such that it functions to chelate the materials which are the precursors of the precipitates, but it does not interfere with other desired aspects of the process. It is noted also that citric acid and complexes formed therewith are environmentally acceptable materials.

In the system shown in the drawing, the quiescent stage in which the oil is removed from the wash water is achieved by transferring the turbulent mixture through a pipe to a separate tank where it is allowed to calm. It should be understood that other means may be provided for obtaining the quiescent stage in which the oil is removed from the wash water. For example, the turbulent mixture of wash water and oil emulsion may be overflowed into a contiguous tank in which it is allowed to calm and from which the liberated oil may be removed.

Also, methods other than skimming the oil film may be used to remove the oil from the wash water. For example, the liberated oil may be absorbed on a material, such as calcium carbonate, which is added to the wash water mixture in the quiescent stage. The oil may also be removed by other mechanical devices such as a centrifuge.

Automatic feed mechanism can also be used to feed demulsifier and chelating agent into the system as needed. For example, it is known that the concentration of an electrolyte in an aqueous solution thereof can be determined by measuring the conductivity thereof. Initially, the desired amounts of demulsifier and chelating agent to use in the process are determined. Suitable available equipment for sensing the conductivity of the aqueous solution of wash water, demulsifier and chelating agent can be incorporated into the apparatus comprising the system. As the conductivity of said solution falls below the predetermined desired amount, appropriate commercially available mechanism, integrated with the conductivity sensor, can be used to trigger the feeding of additional demulsifier and chelating agent into the system, thereby maintaining therein the desired amount of demulsifier and chelating agent.

EXAMPLES

Examples 1 and 2 and comparative examples C-1 to C-6 illustrate the effectiveness of an aqueous pre-wash solution containing a chelating agent, namely citric acid. Table 1 sets forth the compositions of Examples 1 and 2 and C-1 to C-6. In all these examples, 50 ml of hydrocarbon oil emulsion sold by Mobile Oil Co. under the trademark PROSOL 172 having about 6 wt. % oil was used. The emulsions were heated to 130° F. by a water bath and an aqueous solution containing tap water, demulsifier and chelating agent was added. As indicated in Table 1, the separation progress of the oil was observed over one hour's time. A blank space indicates too little separation to measure.

TABLE I

| Ex. No. | Aqueous Demulsifying Solution in wt. % | | | ml. of Aqueous Demulsifying Solution added to 50 ml. of Oil Emulsion | pH of Mixture of Aqueous Demulsifying Solution and Oil Emulsion | % Oil Recovered After | | |
|---|---|---|---|---|---|---|---|---|
| | Tap Water | $Na_2SO_4$ | Citric Acid | | | 20 min. | 40 min. | 60 min. |
| C-1 | 80 | 20 | 0 | 2 | 7.0 | — | — | appr. 26 |
| C-2 | 80 | 20 | 0 | 3 | 7.0 | — | — | 30 |
| C-3 | 80 | 20 | 0 | 4 | 7.9 | 43 | 50 | |
| C-4 | 98 | 0 | 2 | 1 | 4.9 | — | — | appr. 50 |
| C-5 | 98 | 0 | 2 | 2 | 4.5 | — | — | appr. 50 |
| C-6 | 98 | 0 | 2 | 4 | 3.8 | 51 | 53 | 60 |
| 1 | 78 | 20 | 2 | 3 | 6.5 | — | — | 67 |
| 2 | 78 | 20 | 2 | 4 | 6.1 | 93 | 97 | 100 |

From the above examples, it can be seen that the inclusion of citric acid in an aqueous demulsifying solution comprising tap water and sodium sulfate substantially increases the rate of separation of the oil from the oil emulsion.

I claim:

1. In a continuous process wherein oil emulsion is removed from the surfaces of a plurality of articles by contacting the surfaces with an aqueous solution containing an oil insoluble demulsifier for breaking said oil emulsion and wherein said surfaces having said oil emulsion removed therefrom are subsequently contacted with a cleaning solution and wherein the cleaning solution is recycled for contacting additional of said surfaces and wherein precipitates tend to be formed in said recycled cleaning solution, the improvement comprising contacting said surfaces having thereon said oil emulsion with said aqueous solution having included therein a chelating agent in an amount sufficient to deter the formation of said precipitates, said chelating agent being capable of chelating alkaline earth metal ions.

2. A process according to claim 1 wherein said articles are metal articles and including forming on said articles a protective coating after said articles have been cleaned with said cleaning solution.

3. A process according to claim 2 wherein said articles are cans formed by the drawing and ironing technique.

4. A process according to claim 3 wherein said demulsifier is sodium sulfate, said chelating agent is citric acid and said cleaning solution is an alkaline phosphate cleaning solution.

5. A process according to claim 4 including about 0.5 to about 5 wt. % of said sodium sulfate, and about 0.1 to about 0.3 wt. % of citric acid.

6. A process according to claim 1 wherein said aqueous solution includes about 0.5 to about 5 wt. % of said demulsifier and at least about 0.05 wt. % of said chelating agent.

7. A process according to claim 6, wherein the amount of said chelating agent is about 0.1 to about 0.3 wt. %.

8. A process according to claim 1 wherein said chelating agent is citric acid.

9. A process according to claim 1 wherein said cleaning solution is an alkaline cleaning solution and wherein the pH of said aqueous solution is within the range of about 5 to about 8.

10. A process for breaking an oil emulsion comprising contacting the oil emulsion with an aqueous solution comprising an oil insoluble demulsifier and a chelating agent capable of chelating alkaline earth metal ions.

11. A process according to claim 10 wherein said demulsifier is selected from the group consisting of water soluble salts of sulfates, bisulfates, phosphates and chlorides and mixtures thereof and wherein said chelating agent is selected from the group consisting of citric acid, gluconic acid, ethylenediaminetetraacetic acid and pyrophosphoric acid and ammonium and alkali metal salts thereof and water soluble tripolyphosphates.

12. A process according to claim 10 wherein said demulsifier is sodium sulfate and said chelating agent is citric acid.

13. A process according to claim 10 wherein said chelating agent is citric acid.

14. A process according to claim 10 including about 0.5 to about 5 wt. % of said demulsifier and about 0.1 to about 0.3 wt. % of said chelating agent.

15. In a process wherein oil emulsion is removed from the surfaces of a plurality of articles by contacting the articles with an aqueous solution of wash water and an oil insoluble demulsifier to provide a turbulent mixture of said wash water, demulsifier, and oil emulsion and wherein said turbulent mixture is collected and wherein oil liberated from said oil emulsion is allowed to form a separate phase in said wash water and is removed from said wash water in a quiescent stage and wherein said wash water and demulsifier having said oil removed therefrom is recycled for contacting other of said articles, the improvement comprising contacting said articles with said aqueous solution having incorporated therein a chelating agent which is capable of chelating alkaline earth metal ions.

16. A process according to claim 15 wherein said articles are metal cans, and including cleaning the cans and forming on the cleaned cans from which said oil emulsion has been removed a corrosion resistant and paint adherent coating.

17. A process according to claim 16 wherein said demulsifier is sodium sulfate and said chelating agent is citric acid.

* * * * *